US005533330A

United States Patent [19]

Mullooly et al.

[11] Patent Number: 5,533,330

[45] Date of Patent: Jul. 9, 1996

[54] IGNITOR PLUG GUIDE FOR A GAS TURBINE ENGINE COMBUSTOR

[75] Inventors: John F. Mullooly, Stafford Springs; Franklin J. Davis, Glastonbury; Thomas J. Madden, Vernon; Richard R. Wright, Willimantic, all of Conn.

[73] Assignee: United Technologies Corporation, Hartford, Conn.

[21] Appl. No.: 172,968

[22] Filed: Dec. 27, 1993

[51] Int. Cl.[6] ..... F02C 7/264; F02C 7/20

[52] U.S. Cl. ..... 60/39.32; 60/39.821

[58] Field of Search ..... 60/39.821, 39.827, 60/39.31, 39.32, 740

[56] References Cited

U.S. PATENT DOCUMENTS

| | | | |
|---|---|---|---|
| 2,941,363 | 6/1960 | Cuny et al. | 60/39.827 |
| 3,025,425 | 3/1962 | Logan | 60/39.827 |
| 3,116,606 | 1/1964 | Dougherty | 60/39.32 |
| 3,721,089 | 3/1973 | Morrison et al. . | |
| 4,124,737 | 11/1978 | Wolfla et al. | 428/640 |
| 4,216,651 | 8/1980 | Ormerod | 60/740 |
| 4,302,941 | 12/1981 | DuBell | 60/757 |
| 4,380,906 | 4/1983 | Dierberger | 60/757 |
| 4,712,370 | 12/1987 | MacGee . | |
| 5,117,624 | 6/1992 | Roberts, Jr. et al. | 60/39.32 |

*Primary Examiner*—Timothy S. Thorpe

[57] ABSTRACT

A guide (120) for an ignitor plug (105) of a gas turbine engine (10) includes an extend nonrotational bushing (155) having a base (160) slidably received within a hollow sleeve base (135), fixed to the wall of the engine's combustion chamber (65).

6 Claims, 4 Drawing Sheets

70
125
135
160
150
165

125
135
150
160
165

125
135
160
150
165

130
125
145
140
135
160
155
165
150

IGNITOR PLUG GUIDE FOR A GAS TURBINE ENGINE COMBUSTOR

TECHNICAL FIELD

This invention relates generally to gas turbine engine combustors and more specifically to improved ignitor plug guides therefor.

BACKGROUND ART

Typically, gas turbine engine burners include combustion chambers wherein air compressed by the engine's compressor, is mixed with fuel and the mixture burned, thereby increasing the kinetic energy of the airflow through the engine to produce useful thrust. An ignitor plug which functions similarly to a common spark plug in an automobile engine, provides an electrical spark which initiates the combustion. The ignitor plug typically includes a threaded base which is received within a mating threaded hole in the engine's diffuser case for mounting the plug in the combustion chamber. The ignitor plug extends through a hole in the wall of the combustion chamber such that the tip of the plug where an electric spark is formed, lies in the path of the mixture of fuel and air, providing electrical ignition thereof upon engine start-up.

To maintain the proper alignment of the ignitor plug with the various other combustion chamber components such as the fuel nozzle and various air inlet apertures, as well to aid in the insertion of the plug into the combustion chamber for burner assembly and maintenance, an ignitor plug guide is located in the hole in the combustion chamber wall through which the ignitor plug extends.

It will be appreciated that the environment within a gas turbine engine combustion chamber is extremely harsh. The air fuel mixture burns in the combustion chamber at temperatures as high 2100° C. (3800° F.) causing extreme thermal gradients and therefore, thermal stresses in the combustion chamber walls. Moreover, rotational movement of the engine's fan, compressor and turbine, as well as the high flow rate of the air fuel-mixture and the burning thereof, cause significant vibration in the combustion chamber walls. Such high thermal stresses and vibration experienced by the combustion chamber walls are, of course, also experienced by the ignitor plug guide. Prior art ignitor plug guides have, in large measure, failed to adequately tolerate such a harsh vibratory and thermal environment without themselves exhibiting significant vibratory and even rotational movement. Such movement risks not only the misalignment of the ignitor plug with other components in the combustion chamber such as nozzles, air apertures and the like, but also, actual damage to the barrel of the ignitor plug due to relative vibratory and rotational movement between the plug and the guide.

DISCLOSURE OF INVENTION

It is therefore, a principal object of the present invention to provide an improved guide for a gas turbine engine combustor ignitor plug, which can tolerate the thermal and vibratory extremes encountered in gas turbine engine combustion chambers, with minimal risk of damage to the ignitor plug disposed within the guide.

In accordance with the present invention, an improved ignitor plug guide for a gas turbine engine combustion chamber is provided with a bushing through which the ignitor plug is received, the bushing being fixed to a sleeve which mounts the guide to the combustion chamber wall such that the bushing is nonrotatable with respect to the sleeve and plug under the effects of vibration and heat. Since the bushing is incapable of rotation with respect to the ignitor plug, damage to the ignitor plug which would otherwise occur from rotation of the bushing thereagainst, is avoided. The bushing is of an extended length, whereby the ignitor plug is held along an expanded portion of the lateral surface thereof by the bushing, further minimizing damage thereto due to vibration of the guide. The bushing also includes a flanged base received along opposed major surfaces thereof, in surface-to-surface contact with a large hollow base in the sleeve to further minimize vibration, while allowing movement between those two components. The mating surfaces of the bushing base and sleeve base are hardened for prolonged life, as is the interior surface of the bushing which contacts the ignitor plug.

BEST MODE FOR CARRYING OUT THE INVENTION AND INDUSTRIAL APPLICABILITY THEREOF

Figure 1:
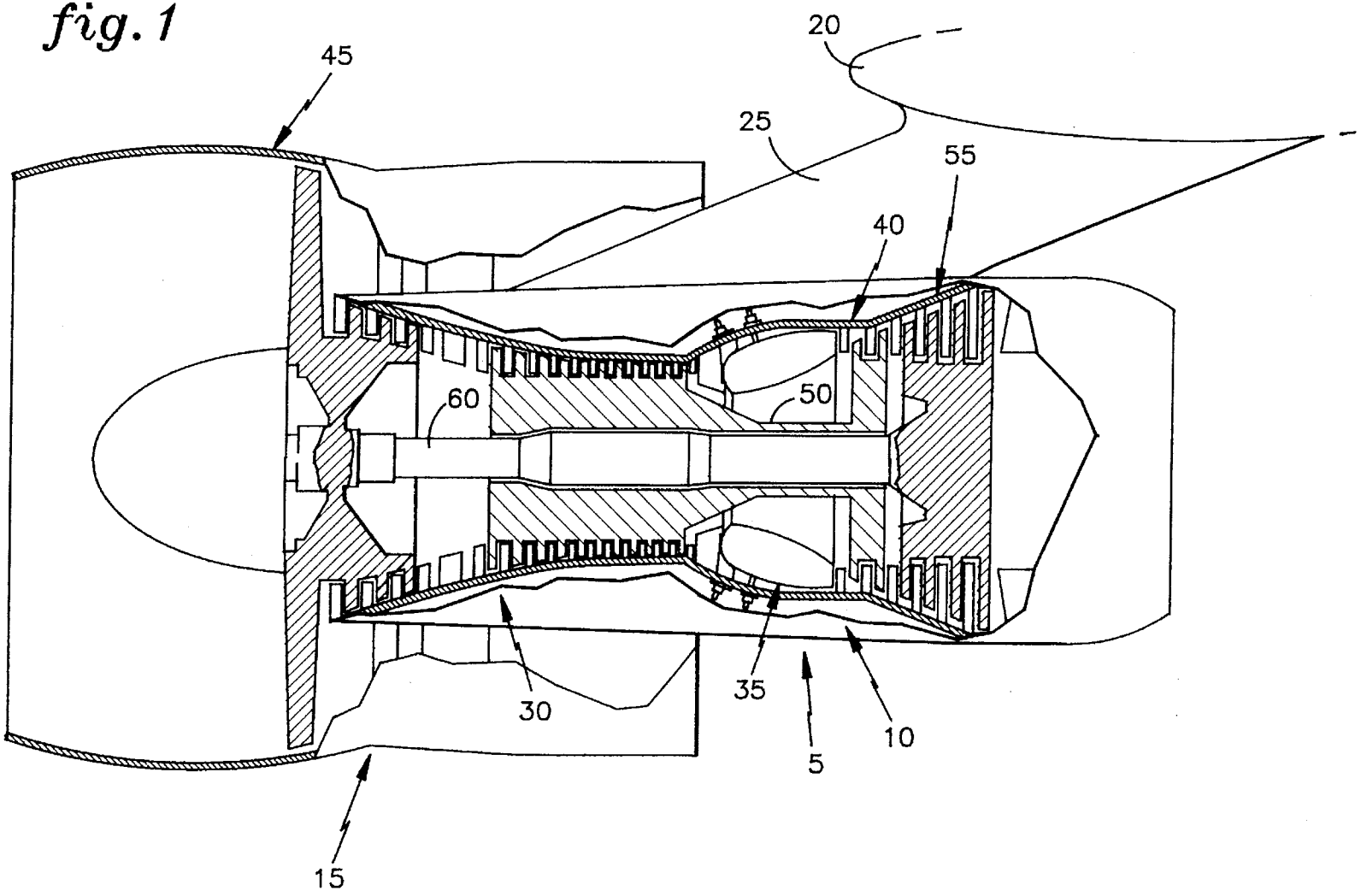
FIG. 1 is a sectioned, schematic elevation of a gas turbine engine of the type employing the ignitor plug guide of the present invention.

Referring to FIG. 1, a gas turbine engine power plant 5 comprising an engine 10 disposed within a nacelle 15 is mounted on the wing 20 of an airframe (not shown) by pylon 25. As is well known in the art, engine 10 comprises a compressor 30 which receives ram air through the inlet of the nacelle and compresses that air, which is then ducted to burner 35 where the air is mixed with fuel and the mixture ignited, thereby substantially increasing the kinetic energy of the airflow through the engine. The products of combustion of the burned air-fuel mixture are expelled from the burner, impinging on the rotor blades of high pressure turbine 40 which is connected to the high pressure section of compressor 30 by axial drive shaft 50. The products of combustion from burner section 35 also impinge upon the rotor blades of low pressure turbine 55 which connects to the low pressure section of compressor 30 and fan 45 by coaxial drive shaft 60 to provide a motive force for driving the compressor and fan. The total thrust provided by the power plant is equal to the sum of the thrust of the exhaust of the engine and the thrust associated with the air discharged by the fan. The foregoing description of the structure and operation of power plant 5 is of course well known in the art.

Figure 2:
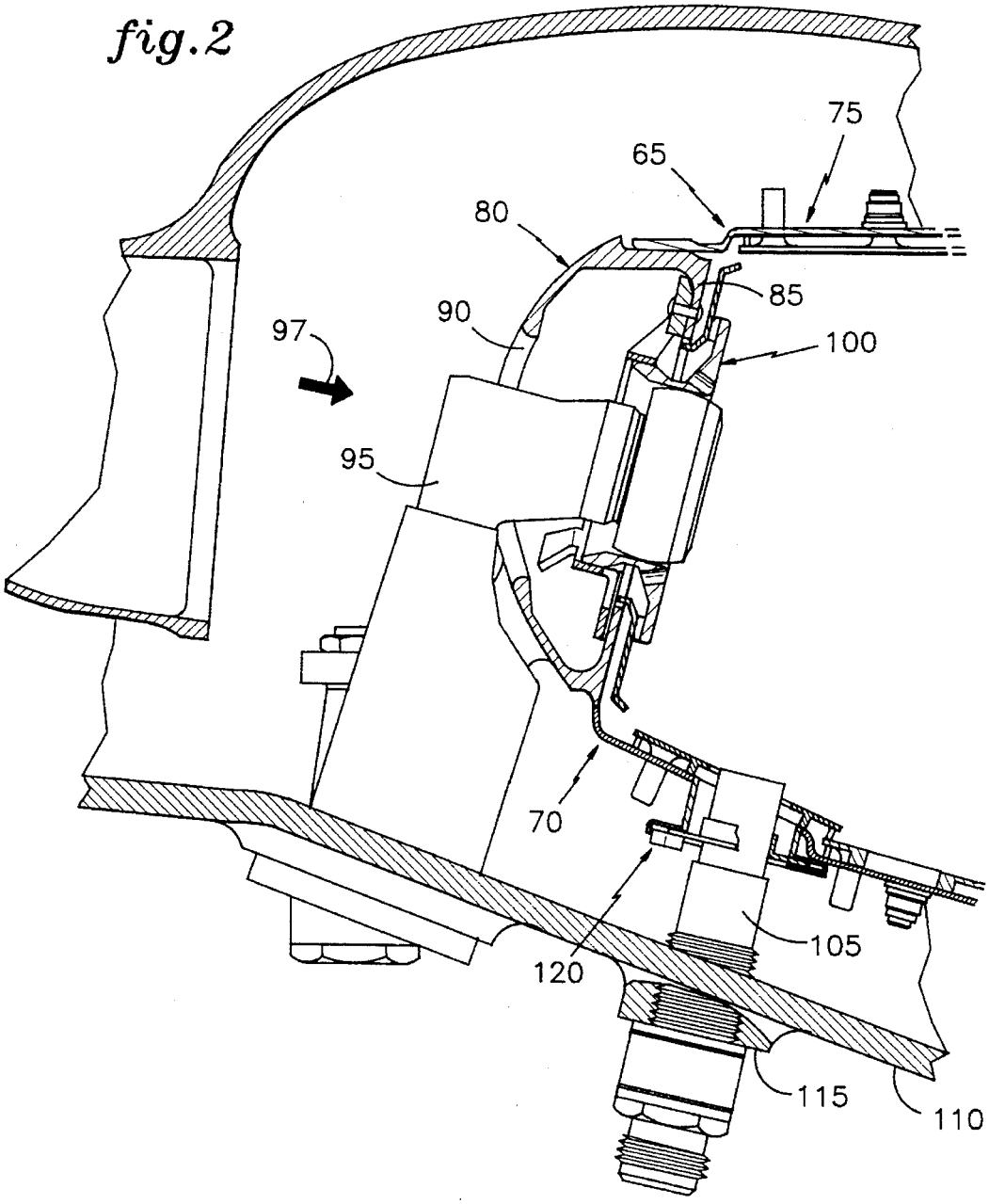
FIG. 2 is a sectioned, partial elevation of a burner of the engine shown in FIG. 1, illustrating the ignitor plug guide of the present invention.

Referring to FIG. 2, burner 35 includes an annular combustion chamber 65 comprising inner and outer walls 70 and 75 respectively, joined along forward edges thereof by a dome 80 including an integral, generally planar bulkhead 85 and several openings 90 through which fuel nozzle 95 extends. Openings 90 also pass combustion air (indicated by arrow 97) to the interior of the combustor to support the combustion of fuel provided by nozzle 95. Nozzle guide structure 100 is provided to guide the insertion of fuel nozzle 95 through bulkhead 85 during assembly of the burner.

Ignition of the mixture of air and fuel within the combustion chamber upon engine startup is provided by an ignitor plug 105 secured to diffuser case 110 by threaded engagement therewith at mount 115. Alignment of the ignitor plug with the combustion chamber is effected by ignitor plug guide 120 of the present invention which also provides a means for guiding the ignitor plug into position within the interior of the combustion chamber upon assembly of the burner.

Figures 3, 4, 5, 6:
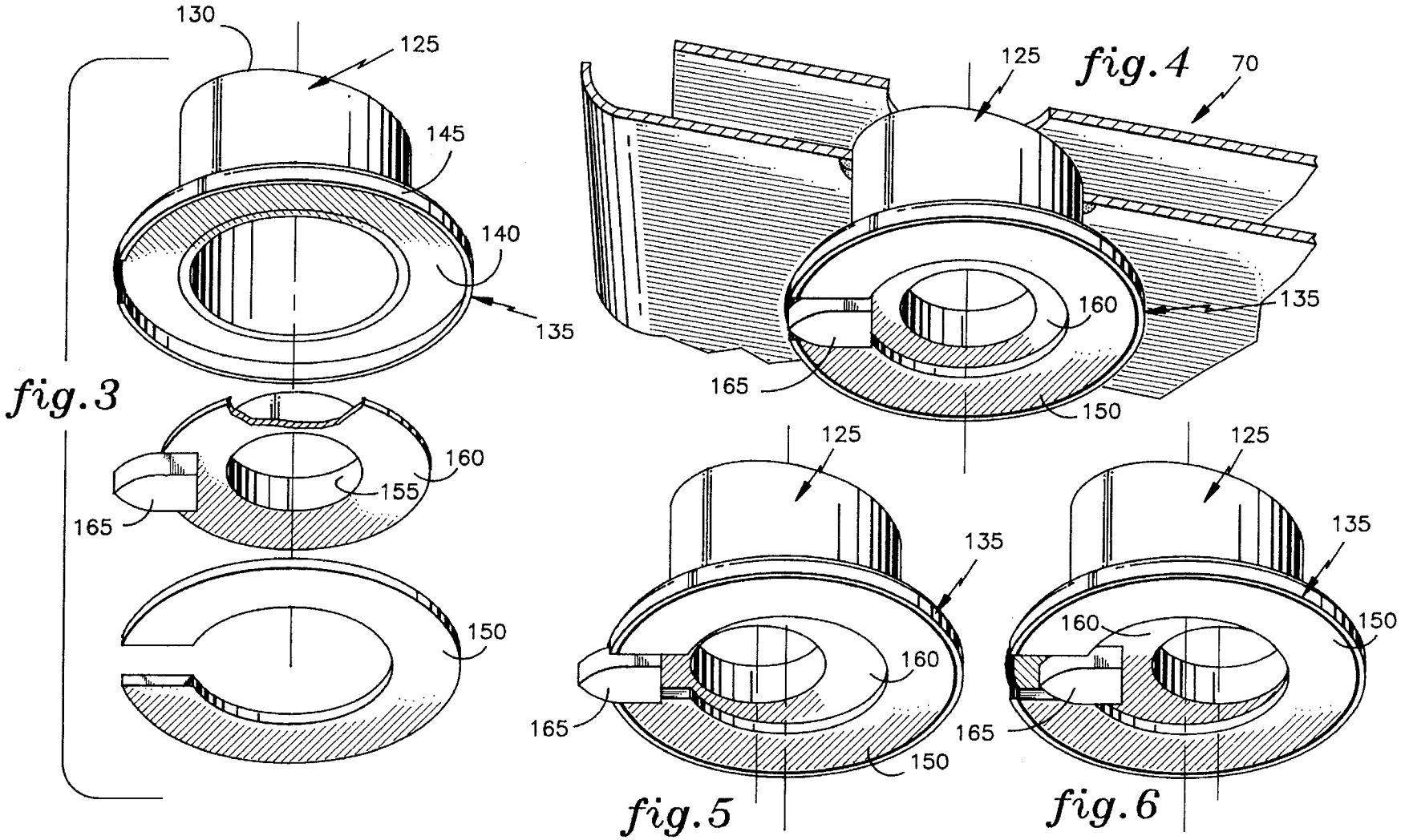
FIG. 3 is an exploded isometric view of the ignitor plug guide of the present invention.
FIG. 4 is an isometric view of the ignitor plug guide of the present invention assembled with the combustion chamber wall of the burner.
FIG. 5 is an isometric view of the ignitor plug guide of the present invention showing the components thereof in one relative orientation.
FIG. 6 is an isometric view similar to FIG. 5 showing the components of the ignitor plug in a second relative orientation.

Referring to FIG. 3, ignitor guide 120 comprises a generally cylindrical sleeve 125 having a canted outer end 130 which aligns with the combustor walls and terminating in a hollow, slotted and flanged base 135. As best shown in FIG. 3, base 135 comprises a flange 140 fixed to sleeve 125 at the outer end thereof as by welding or the like, flange 140 including a downturned outer edge 145. A slotted annular member 150 is attached to downturned edge 145 as by welding or the like and provides closure of the base.

Received within base 135 is a bushing 155 having a flanged generally annular base 160 comprising two generally opposed planar surfaces and an edge surface and provided with a lug 165 having a pointed (boat-shaped) outer end attached to a peripheral portion of the lower face of base 160 as by welding or the like. As best seen in FIGS. 4–6, bushing 155 is received within sleeve 125 and bushing base 160 is received within hollow sleeve base 135 such that the lug 165 is received within the slot in annular member 150.

Inasmuch as the outer diameter of the bushing is substantially less than the inner diameter of the sleeve, and the outer diameter of the bushing base is substantially less than the inner diameter of the hollow sleeve base, the bushing is slidable in an axial direction (with respect to engine 5). The registry of lug 165 with the slot in base 160 prevents the rotation of the bushing inside the sleeve and damage to the plug attendant with such bushing rotation. Movement of the bushing within the sleeve accommodates thermal growth for thermal stress relief during normal operation of the engine and also simplifies the assembly of the engine by enhancing the ease with which the ignitor plug is inserted through the combustor wall. The pointed end of lug 165 allows a slight degree of pivoting of the bushing with respect to the sleeve for added freedom of movement, particularly when the bushing and sleeve are aligned as in FIG. 6, without sacrificing the stability associated with the lug length illustrated herein.

Damage to the plug due to vibration of the guide is also minimized by the expanse of the bushing which is, in height, approximately 0.35 times the diameter of the bushing. This expanse not only more evenly distributes vibratory forces along the lateral surface of the ignitor plug, but tends to prevent the bushing from engaging in any rocking motion due to burner vibration.

Bushing base 160 is, along opposed major surfaces thereof, received between, and is maintained in surface-to-surface contact with corresponding opposed major interior surfaces of the sleeve base. This further reduces any tendency of the bushing to rock back and forth in response to combustor vibration and the attendant damage to the lateral surface of the ignitor plug.

These major surfaces of the sleeve and bushing bases, as well as the interior surface of the bushing itself may be hardened with a wear resistant coating thereon such as a known coating consisting essentially of a mixture of 75% chromium carbide and 25% of an 80% nickel and 20% chromium alloy, plasma sprayed on the surfaces.

Figure 7:
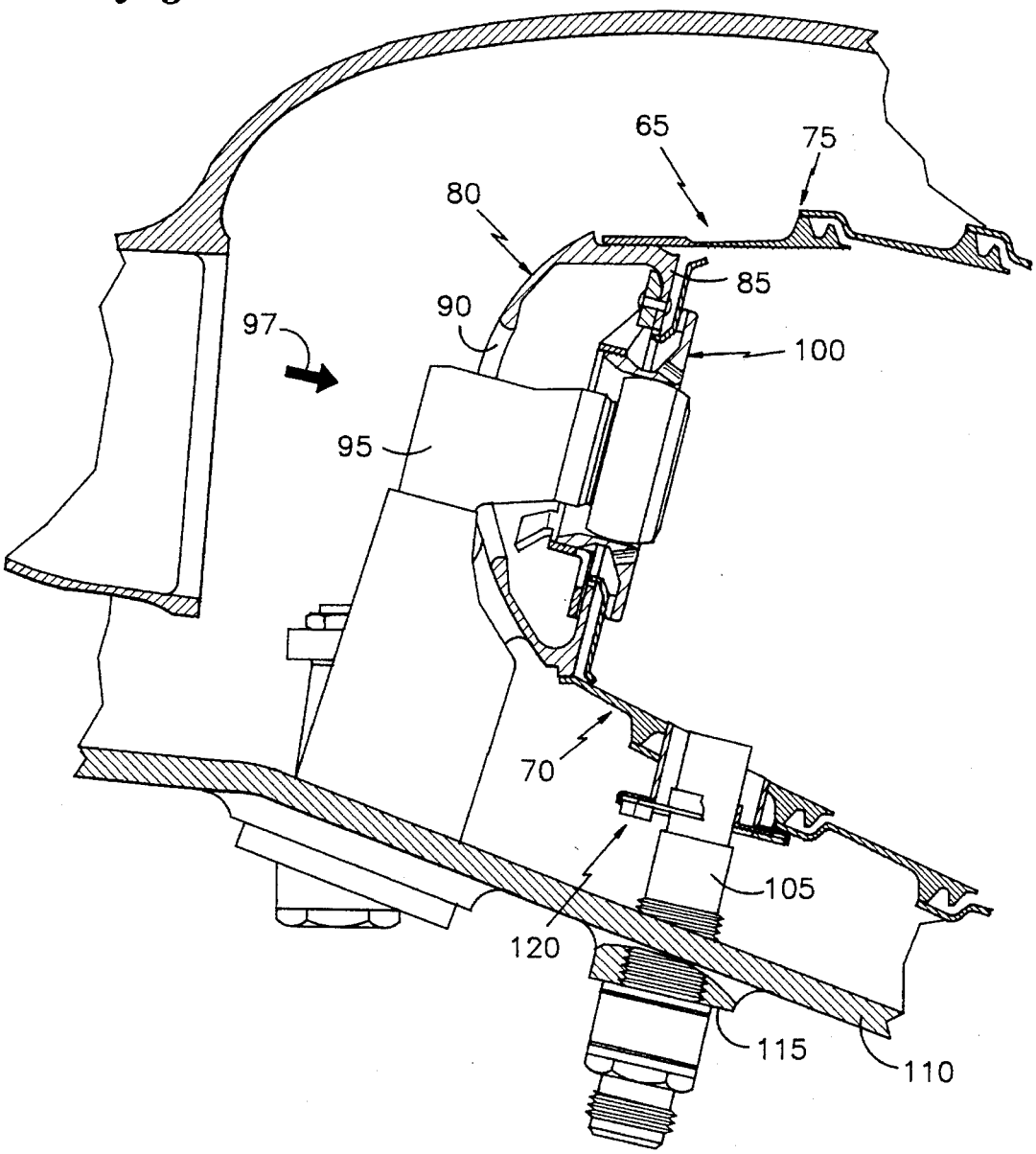
FIG. 7 is a sectioned, partial elevation similar to FIG. 6 of the ignitor plug guide of the present invention, employed with an alternate combustor wall structure.

As shown in FIG. 2, the ignitor plug guide is mounted to the combustor by attachment to wall 70 thereof as by welding or other appropriate diffusion bonding techniques as will be determined by the types of materials employed in the combustor wall and the guide. Those skilled in the art will recognize the combustor wall structure shown in FIG. 2 as being a FLOATWALL™, double-walled construction which is disclosed in U.S. Pat. No. 4,302,941 and employed in modern gas turbine aircraft engines manufactured by the Pratt & Whitney Division of the assignee of the present invention, United Technologies Corporation. However, as shown in FIG. 7, the guide of the present invention may also be employed with a shingled or "DOUBLE PASS" combustor wall structure also employed in current gas turbine aircraft engines produced by the above-noted Pratt & Whitney Division of the assignee herein, United Technologies Corporation, and disclosed in U.S. Pat. No. 4,302,941.

While the ignitor plug guide of the present invention has been shown in a particular embodiment thereof, it will be appreciated that various modifications will suggest themselves to those skilled in the art. For instance, the canting of the end of sleeve 125 to conform to the angular orientation of the combustor wall can be varied in accordance with combustors of varying geometries. It is intended by the following claims to cover these and all other modifications which suggest themselves to those skilled in the art and which fall within the true spirit and scope of this invention.

Having thus described the invention what is claimed is:

1. A guide for an ignitor plug employed in the combustor of a gas turbine engine, said guide comprising a generally cylindrical sleeve adapted for fixture to a wall of said combustor in registry with an aperture in said wall, said ignitor plug being received through said wall, said guide further comprising a bushing received within said sleeve, which engages, along an interior lateral surface thereof, an exterior lateral surface of said ignitor plug, said guide being characterized by:

said sleeve terminating in a hollow, slotted and flanged base;

said bushing having a ranged base including a lug received within said slot in said flanged sleeve base to prevent relative rotation between said bushing and said sleeve and attendant damage to said ignitor plug therefrom.

2. The guide of claim 1 characterized by said bushing base comprising a pair of opposed generally planar surfaces and an edge surface, said bushing base along opposed planar surfaces thereof being received between, and maintained in slidable surface-to-surface contact with corresponding opposed interior surfaces of said hollow sleeve base.

3. The guide of claim 2 characterized by said planar surfaces of said bushing base and said opposed planar interior surfaces of said hollow sleeve are hardened with a wear-resistant coating thereon.

4. The guide of claim 3 characterized by said wear resistant coating consisting essentially of a mixture of chromium carbide and a nickel-chromium alloy.

5. The guide of claim 1 characterized by the ratio of the height of said bushing measured axially with respect to said ignitor plug, to the diameter of that portion of the bushing which accommodates the ignitor being approximately 0.35.

6. The guide of claim 1 characterized by said lug having a pointed outer end.

* * * * *